US005296714A

United States Patent [19]

Treglio

[11] Patent Number: 5,296,714

[45] Date of Patent: Mar. 22, 1994

[54] METHOD AND APPARATUS FOR ION MODIFICATION OF THE INNER SURFACE OF TUBES

[75] Inventor: James R. Treglio, San Diego, Calif.

[73] Assignee: ISM Technologies, Inc., San Diego, Calif.

[21] Appl. No.: 905,350

[22] Filed: Jun. 29, 1992

[51] Int. Cl.[5] ..... H01J 49/42

[52] U.S. Cl. ..... 250/492.3; 250/492.1; 250/396 R; 315/111.41

[58] Field of Search ..... 250/492.3, 492.1, 423 R, 250/424, 398, 396 R; 315/111.21, 111.31, 111.41, 111.61, 111.81

[56] References Cited

U.S. PATENT DOCUMENTS 3,163,798 12/1964 Salz et al. ..... 315/111.41

*Primary Examiner*—Paul M. Dzierzynski
*Assistant Examiner*—Kiet T. Nguyen
*Attorney, Agent, or Firm*—Frank D. Gilliam

[57] ABSTRACT

A method and apparatus for modifying the inner surface of a tube by ion surface modification techniques, such as ion implantation, ion mixing and ion beam assisted coating. The apparatus includes a plasma source, preferably a vacuum arc, a first magnet for guiding the plasma into a drift tube. A second magnet is spaced from the first magnet and has a current running opposite to the first magnet. A radial extractor surrounds the area between the magnets, which form a cusp therebetween. The plasma follows the field lines, exiting the drift tube to the extractor, where the ions are removed and accelerated outwardly in a radial direction. With the entire apparatus placed in a tube, the ions will impact the inner wall of the tube. The resulting ion implantation advantageously modifies the surface, typically increasing wear and erosion resistance, improving corrosion resistance, increasing fatigue life, etc. The apparatus may be used to coat the tube interior with the cathode material by operating the extractor at a lower voltage or omitting the extractor. The apparatus may be inserted in tubes and moved along the tube to treat the walls of very long tubes.

16 Claims, 1 Drawing Sheet

METHOD AND APPARATUS FOR ION MODIFICATION OF THE INNER SURFACE OF TUBES

BACKGROUND OF THE INVENTION

This invention relates in general to ion impact surface modification techniques and, more specifically, to methods and apparatus for improving the physical characteristics of the internal walls of tubes by ion impact treatments including ion implantation, ion mixing, and ion beam assisted deposition of coatings.

Piping in power plants and the like often suffers from corrosion and erosion. These problems require regular inspection and replacement, which often requires the plant to close down for repair and replacement work. Improvements in interior surface hardness and improved corrosion resistance would reduce the need for such costly repairs.

Corrosion in nuclear reactor piping systems is a particularly significant problem. Corrosion products from the pipes and other system components flow into the reactor and become radioactive. These then settle in low points in the system, typically valves, drains and pumps, representing a radiation hazard to personnel doing maintenance on the reactor. Corrosion products circulating in reactor piping also adversely affects the operation of flow venturies that are used to measure flow. The venturies are restrictions that permit water flow to be calculated from the measured pressure drop across the restrictions. Corrosion products selectively deposit in these venturies, altering the flow calibration such that the reactor power level must be reduced by as much as a few per cent, at significant cost to the plant operator. Various additives are used to reduce corrosion and expensive, more corrosion resistant, metals must often be used. Thus, there would be significant savings in any pipe treatment that reduced corrosion.

Erosion of the interior of pipes subjected to high flow rates is a problem in many piping systems. Reduction in erosion could significantly increase the life span of such piping components. Uniform hardening of the interior surfaces could significantly reduce erosion damage.

High vacuums are required in various specialized tubular systems, such as high energy physics experiments (such as the Superconducting Super Collider) and fusion energy systems. In order to maintain high vacuums in such systems, outgassing through the component walls must be reduced or eliminated. Presently, no full effective system for preventing such outgassing exists.

Effective treatment or coating of the interior surfaces of such tubes or tubular components could be very advantageous in reducing corrosion, erosion and outgassing.

A number of different methods have been developed for depositing materials, generally metals, in the form of particles or ions onto a target surface to form an adherent, uniform coating. Among these are thermal deposition, cathode sputtering and chemical vapor deposition. While useful in particular applications, these methods suffer from several problems, including a tendency to coat other system surfaces than the target with the material being deposited, requiring frequent cleaning, contamination problems when the coating material is changed and a waste of often expensive coating material. Generally, these processes require that the target surface be heated to a very high temperature which often damages the target material. The high deposition temperatures also lead to thermal stresses that may cause coating delamination. These processes are quite effective in coating flat or slightly curved surfaces, but are not adaptable to coating the interior surface of relatively narrow tubes. Where not very highly adherent, these coatings may not effectively harden or change the surface to increase resistance to corrosion and erosion, and generally are too porous to prevent outgassing.

Vacuum arc deposition has a number of advantages for coating difficult materials, such as refractory metals, onto targets. Vacuum arc deposition involves establishing an arc, in a vacuum, between a cathode formed from the coating material and an anode, which results in the production of a plasma of the cathode material suitable for coating. The process does not involve gases, making control of deposition rate easier and simplifies changing coating materials. Typical vacuum arc deposition systems are described in U.S. Pat. Nos. 3,566,185, 3,836,451 and 4,714,860. Vacuum arc deposition, sometimes referred to as cathodic arc deposition, is used commercially, typically to produce titanium nitride coatings on tooling. While the coatings formed by these methods are generally hard and resistant to erosion, they may not resist corrosion or erosion to the full extent required. Vacuum arc deposition is a line-of-sight process, making it virtually impossible to modify or coat the inner surfaces of tubes and pipes with existing technology.

Thus, there is a continuing need for methods and apparatus for treating and/or coating the interior surfaces of pipes and tubes to form a corrosion, erosion and outgassing resistant surface.

SUMMARY OF THE INVENTION

It is, therefore, an object of this invention to provide a method and apparatus for treating the interior surfaces of tubes that overcomes the above-noted problems. Another object is to provide a method and apparatus for ion surface modification of the interior walls of tubes. Yet another object is to improve the resistance of tube interior walls to corrosion, erosion and outgassing. A further object is to provide an apparatus for continuously treating the interior of a elongated tube with high energy metal ions. Still another object is to coat the interior walls of tubes by ion assisted deposition.

The above-noted objects, and others, are accomplished in accordance with this invention by a method and apparatus that basically comprises a plasma source producing a metal ion plasma, a first annular magnet for guiding the plasma into a drift tube, a second annular magnet spaced from the first magnet forming a magnetic cusp between the magnets and a radial extractor surrounding the volume between the magnets.

The second magnet has current flowing in a circular direction opposite to the flow in the first magnet, forming a magnetic cusp between the magnets which drives metal ions from the plasma outwardly through the radial extractor.

The extractor separates metal ions from any other particles that may be in the plasma region and drives them at high energy levels against the interior of any tube into which the apparatus is inserted. That surface is uniformly treated by moving the apparatus through the tube at a steady rate.

Where ion implantation alone is desired, the extractor will typically be operated at voltages in the 20,000 to 100,000 volt range. Where coating with the cathode metal is desired, the extractor structure may typically be operated at around 1000 volts. Alternatively, the system may be used without the extractor if coating only is intended.

Prior attempts to treat surfaces by vacuum arc deposition have encountered problems with macroparticles contaminating the surface being treated. Macroparticles are drops of the cathode material, usually between 1 and 100 micrometers in diameter, emitted at high velocities from the cathode surface during vacuum arc discharges. With most vacuum arc discharge systems, at least some of these particles will reach the target. In the system of this invention, those particles emitted nearly parallel to the cathode surface will not pass through the hole in the anode. Some of those particles emitted substantially perpendicular to the cathode surface will pass through the anode hole. However, since the macroparticles are not affected by the magnetic field between the first and second magnets, they will not be diverted through the extractor to the surface being treated. Since there is thus no line of sight between cathode and target, contamination with macroparticles cannot occur.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
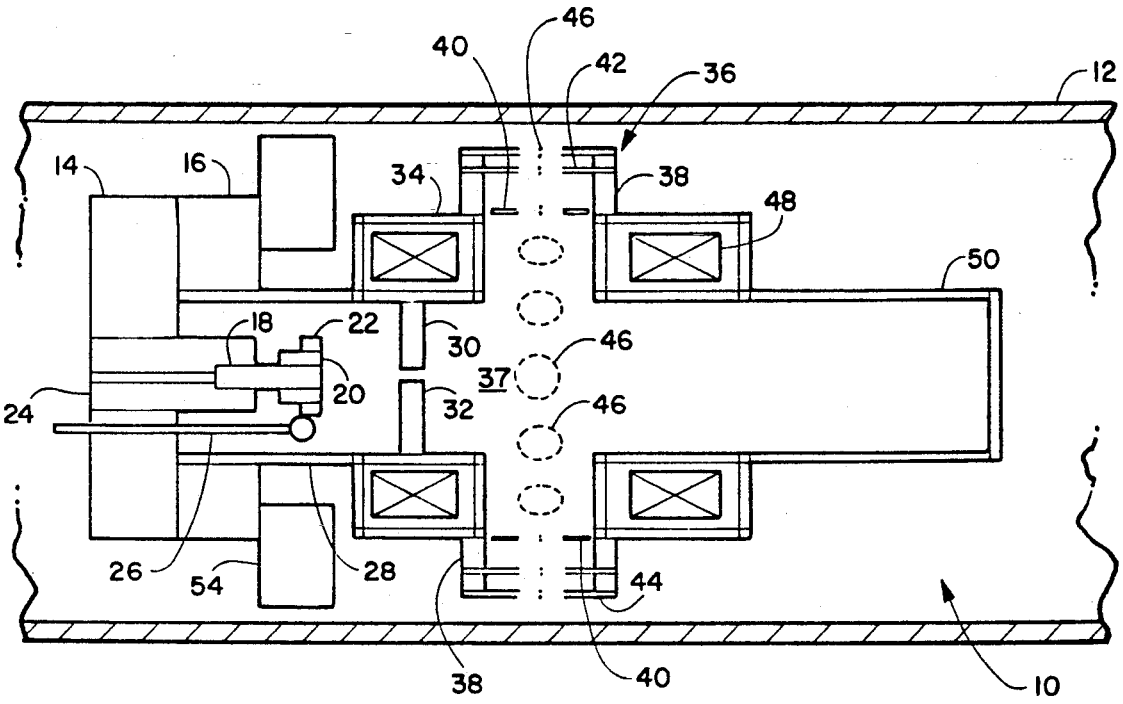
FIG. 1 is a schematic axial section through the ion producing and applying apparatus of this invention.

Referring now to FIG. 1, there is seen a schematic view taken along the axis of the apparatus 10, which overall is a surface of revolution. The apparatus is shown positioned within a tube 12.

Apparatus 10 is supported on an electrically insulating base 14 and ring 16. A cylindrical cathode 18, surrounded by an electrically insulating tube 20 and a trigger ring 22, is supported on a pedestal 24. The insulating components are typically high temperature resistant ceramics. A conventional trigger electrode 26 is positioned adjacent to trigger ring 22. An elongated tube 28 mounted on base 14 surrounds the cathode assembly and serves to support the remaining components of apparatus 10. Any suitable cathode may be used, including the cathode described in U.S. Pat. No. 5,089,707, assigned to the assignee of this application.

An anode 30 having one or more central holes 32 is positioned in tube 28 spaced from cathode 18. Anode 30 may be formed from any suitable electrically conductive material, such as copper.

An annular first electromagnet 34 is positioned around anode 30. This magnet typically is operated at fields of from about 100 to 1000 gauss.

A extractor assembly 36 is positioned adjacent to first magnet 34 surrounding a drift tube volume 37 adjacent to anode 30. Extractor 36 includes three spaced, coaxial, cylindrical electrodes mounted on walls 38. The electrode assembly includes an inner extraction electrode 40, operated at from about 20 to 100,000 KV, a central electron suppressor electrode 42 typically operated at less than 5 KV negative and an outer ground electrode 44. Where significant coating of the tube interior is desired, the extraction electrode 40 may be operated at around 1000 volts, typically in the range of about 500 to 2000 volts. These electrodes are separated from walls 38 and each other by electrically insulating material. Holes 46, arranged in a uniform radial pattern around the electrodes, extend in axial alignment through the electrodes.

A second electromagnet 48 surrounds an extension 50 to tube 28 adjacent to extractor assembly 36. Magnet 48 is generally similar to first magnet 34, except that the current flows in the opposite direction.

Apparatus 10 in the schematic representation shown, slides along the inner wall of tube 12 on the outer surface of ring 54. Any other suitable means for supporting apparatus 10 for longitudinal movement in a tube, such as wheels, rollers or the like, may be used. The apparatus may be moved through the tube at a uniform rate by any suitable mechanism, such as a long lead screw, powered wheels supporting the apparatus, etc.

Figure 2:
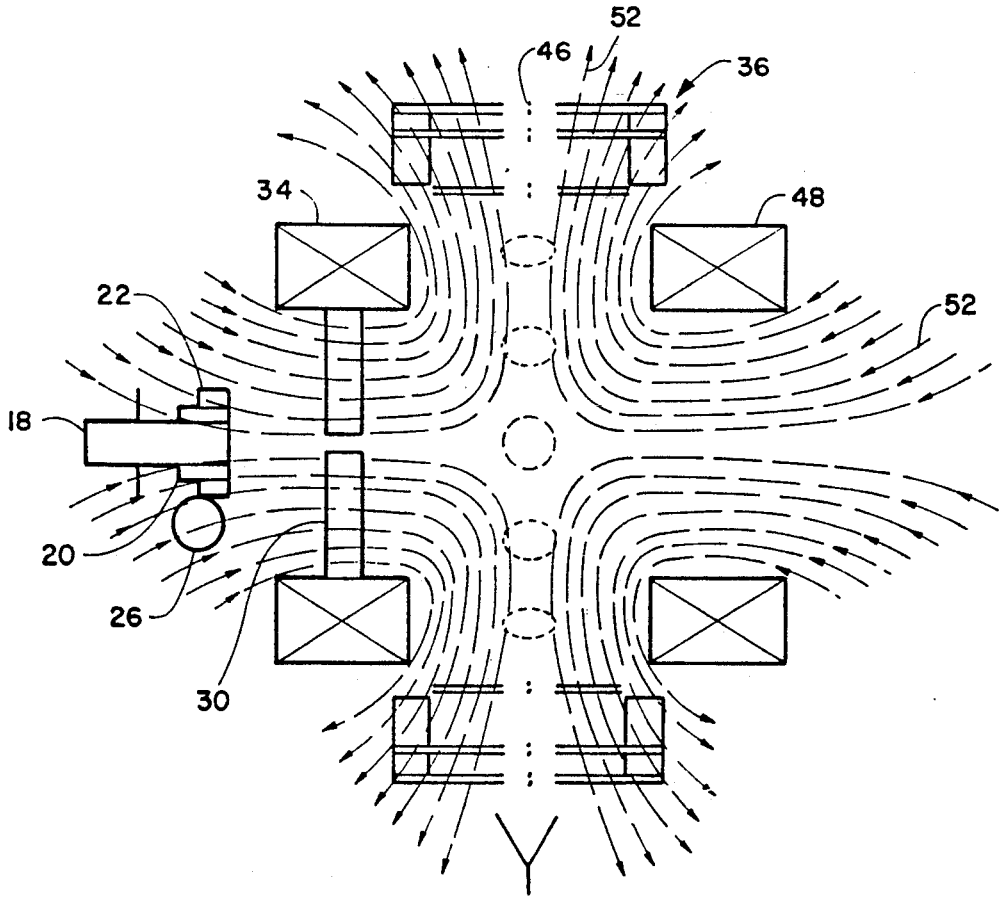
FIG. 2 is a schematic axial section view illustrating the magnetic field in the apparatus.

FIG. 2 schematically illustrates the magnetic field produced by magnets 34 and 48, with the lines of force 52 as shown forming a magnetic cusp between the magnets, to drive ions within drift tube volume 37 outwardly through holes 46 in extractor assembly 36 to impact on the inner wall of tube 12.

In the operation of this apparatus, a cathode 18 of a selected metal compound is installed. Typical metals include chromium, titanium, aluminum, molybdenum, tantalum, yttrium, platinum, rhenium and alloys or mixtures thereof. The interior of tube 12 is pumped down to a suitable vacuum through conventional means, with conventional seals provided for electrical cables, drive means, etc connected to apparatus 12. When a high voltage is applied between trigger ring 22 and cathode 18, a vacuum arc discharge is initiated from a tiny spot (typically less than one micrometer in diameter) on the cathode surface. The current density in this spot is enormous, well over one million amperes per square inch. So large is the current density that material from the cathode is pulled from the surface and ionized. Ionization is almost total, to the extent that most of the ions are multiply charged. The trigger pulse typically lasts only about a tenth of a millisecond, just long enough to initiate the vacuum arc breakdown.

The plasma from this arc fills the cavity between cathode 18 and anode 30 so that a relatively low (typically about 20 volts) voltage between the cathode and anode is sufficient to sustain the arc. The ionization of the cathode metal is nearly 100%. It is so extensive that most of the metal ions will be doubly charged.

The plasma produced by the arc flows outward from cathode 18 through the hole 32 in anode 30 and into plasma drift tube or channel 37. The housings of magnets 34 and 48 are preferably tied directly to anode 30, to serve as additional anodes. Since anode 30 is preferably placed at the center of first magnet 34, the magnetic field at anode 30 is greater than that on the surface of cathode 18 where the plasma originates. The magnet over the anode thus serves to aid in funneling plasma from the cathode through anode opening 32.

Ions from the plasma within drift tube 37 are mostly directed out through holes 46 to the inner surface of tube 12 by the magnetic field. Plasma that does not duct out to the sides will travel to the center of second magnet 48. Some of the plasma will pass through to the back wall of tube 50, some will mirror back to anode 30 and some will mirror back to the sides of drift tube 37, joining the plasma from anode 30. The mixing of this reflected plasma with the initial plasma provides a less volatile plasma for extractor 36.

The ions are applied by exposing the inner surface of the tube 12 to the plasma. As the apparatus is moved along tube 12, a uniform surface treatment of the interior of tube 12 is accomplished.

Other applications, variations and ramifications of this invention will occur to those skilled in the art upon reading this disclosure. Those are intended to be included within the scope of this invention, as defined in the appended claims.

We claim:

1. An apparatus for ion modification of the inner surface of tubes which comprises:

a metal ion plasma source;

a drift tube adjacent to the plasma source;

a first ring magnet for guiding plasma from said plasma source into said drift tube;

a second ring magnet spaced from said first magnet and having a current opposite to that in said first magnet so that a magnetic cusp is formed therebetween which guides said plasma outwardly along magnetic field lines;

a radial extractor surrounding the volume between said magnets including means for receiving said plasma from said drift tube, separating ions from said plasma and accelerating said ions radially outwardly;

whereby the interior of a tube placed around said apparatus is impacted by said ions.

2. The apparatus according to claim 1 wherein said plasma source comprises:

a cylindrical cathode formed for the material to be deposited;

an insulating ring around said cathode;

a trigger ring around said insulating ring;

a trigger in contact with said trigger ring;

an anode between said cathode and said drift tube, said anode having at least one opening through which plasma generated at said cathode being moved to said drift tube.

3. The apparatus according to claim 2 wherein said cathode is located at about the center of said first magnet.

4. The apparatus according to claim 2 wherein said magnets are at least partially surrounded by housings formed from non-magnetic, electrically conductive, material and said housings are electrically connected to said anode.

5. The apparatus according to claim 1 wherein said extractor comprises:

a tubular extractor electrode surrounding said drift tube;

a tubular electron suppressor electrode surrounding said extractor electrode and electrically insulated therefrom;

a tubular ground electrode surrounding said electron suppressor electrode and electrically insulated therefrom;

a plurality of aligned radial holes through said electrodes.

6. The apparatus according to claim 1 wherein said metal ions are selected from the group consisting of ions of aluminum, titanium, molybdenum, tantalum, chromium, yttrium, platinum, rhenium and alloys and mixtures thereof.

7. An apparatus for coating the inner surface of tubes by vacuum arc deposition which comprises:

a metal ion plasma source;

a drift tube adjacent to the plasma source;

a first ring magnet for guiding plasma from said plasma source into said drift tube;

a second ring magnet spaced from said first magnet and having a current opposite to that in said first magnet so that a magnetic cusp is formed therebetween which guides said plasma outwardly along magnetic field lines;

whereby the interior of a tube placed around said apparatus is coated with the plasma material.

8. The apparatus according to claim 7 wherein said plasma source comprises:

a cylindrical cathode formed for the material to be deposited;

an insulating ring around said cathode;

a trigger ring around said insulating ring;

a trigger in contact with said trigger ring;

an anode between said cathode and said drift tube, said anode having at least one opening through which plasma generated at said cathode being moved to said drift tube.

9. The apparatus according to claim 8 wherein said cathode is located at about the center of said first magnet.

10. The apparatus according to claim 9 wherein said metal ions are selected from the group consisting of ions of aluminum, titanium, molybdenum, tantalum, chromium, platinum, rhenium and alloys and mixtures thereof.

11. The apparatus according to claim 8 wherein said magnets are at least partially surrounded by housings formed from non-magnetic, electrically conductive, material and said housings are electrically connected to said anode.

12. A method of modifying the interior surface of a tube by ion impact which comprises the steps of:

creating a metal ion plasma;

magnetically directing said plasma into a drift tube;

creating a magnetic field in said drift tube driving said plasma radially outwardly;

extracting ions from said plasma and accelerating said ions radially outwardly;

whereby said ions impact the interior surface of the tube located around said extracting.

13. The method according to claim 12 wherein said metal ion plasma is created and directed to a drift tube by providing a high voltage to a cathode to produce an arc discharge to pull and ionize material from the cathode and form said plasma adjacent to the cathode and passing said plasma through at least one opening in an anode under the influence of said magnetic field.

14. The method according to claim 12 wherein said ions are extracted and accelerated radially outwardly by forming said magnetic field having lines of force extending radially outwardly and directing the ions through openings in an extractor assembly.

15. The method according to claim 14 wherein said extractor structure is operated at a voltage of from about 20,000 to 100,000 volts and ions are implanted said interior surface of said tube without significant coating.

16. The method according to claim 14 wherein said extractor structure is operated at about 500 to 2000 volts and said interior surface of said tube is coated with cathode material.

* * * * *